United States Patent [19]

Hudson

[11] 4,024,702

[45] May 24, 1977

[54] COMBUSTION PRODUCTS PRESSURE GENERATORS CONTINUOUS BURNER TYPE AND ENGINES

[76] Inventor: Perry David Hudson, 515 Delaine Drive, Corpus Christi, Tex. 78411

[22] Filed: Sept. 23, 1970

[21] Appl. No.: 74,703

[52] U.S. Cl. ..... 60/39.27; 60/39.6; 60/39.65; 60/39.81; 60/39.82 P

[51] Int. Cl. ..... F02g 1/02

[58] Field of Search ..... 60/39.6, 39.63, 39.69, 60/39.23, 39.82 P, 39.82 R, 39.65, 39.28 T, 39.82 S; 431/116; 123/148 C, 148 DS

[56] References Cited

UNITED STATES PATENTS

| | | | |
|---|---|---|---|
| 782,205 | 2/1905 | Webb | 60/39.63 X |
| 972,504 | 10/1910 | Brown | 60/39.63 X |
| 1,302,582 | 5/1919 | Norman | 60/39.63 |
| 1,608,446 | 11/1926 | Trent | 60/39.6 X |
| 1,857,556 | 5/1932 | Lasley | 60/39.23 |
| 2,227,666 | 1/1941 | Noack | 60/39.23 X |
| 2,446,059 | 7/1948 | Peterson | 60/39.23 UX |
| 2,459,447 | 1/1949 | Milliken | 60/39.63 |
| 2,485,207 | 10/1949 | Logan | 60/39.23 UX |
| 2,517,399 | 8/1950 | McCollum | 431/116 |
| 2,644,299 | 7/1953 | Williams | 60/39.23 |
| 2,688,230 | 9/1954 | Milliken | 60/39.63 |
| 2,715,816 | 8/1955 | Thorn | 60/39.23 UX |
| 2,812,637 | 11/1957 | Fox | 60/39.23 X |
| 2,977,759 | 4/1961 | Milliken | 60/39.69 |
| 3,171,253 | 3/1965 | Milliken | 60/39.63 |

FOREIGN PATENTS OR APPLICATIONS

| | | | |
|---|---|---|---|
| 619,353 | 3/1949 | United Kingdom | 60/39.23 |

*Primary Examiner*—Carlton R. Croyle
*Assistant Examiner*—Robert E. Garrett

[57] ABSTRACT

This invention comprises improvements in combustion products pressure generators of the continuous burner type or expansion chamber type and reciprocating piston engine or turbines which uses the combustion products the expansion chamber produces for power and to drive the air compressor, which supplies combustion air to the expansion chamber.

The intent is to produce a multi-fuel propulsion unit suitable for vehicles, boats and ships, locomotives, etc;, where the load varies widely and rapidly.

These power units are very economical on fuel and virtually emission free. They will burn most any free flowing liquid fuel, are instant starting, and burn no fuel when idle.

The system compresses air with a reciprocating piston compressor controlled by variable volume means and or unloaders. This compressed air goes through an exhaust heated preheater to 800 degrees F, then to the combustion chambers where it is heated to 1600 degrees F by one or more burners at the volume required. Part of the compressed air goes to storage receivers which maintains a constant pressure on the combustion chamber. The combustion chamber has a circulating fan inside the combustion chamber driven by an outside power which circulates part of the air inside the combustion chamber through the burners for combustion air and the balance of the fan output goes through a jacket around the burners for cooling and into the hot gases from the burners to dilute the hot gases to workable temperatures. The fan also recirculates the air within the combustion chamber through the burners to burn up any gases that did not burn first pass. This circulating fan should have the volume capacity of two or more times the volume of gases passing through the combustion chamber so as to recirculate the gas through the burners to get a clean burn and make less air pollution.

The air compressor cylinders are a part of or connected to the power engine or turbine and only turns when the engine turns. As most of my engines are designed to drive direct through gears without clutch or transmission, the engine only turns when the vehicle moves, so when the vehicle stops and the engine is on standby, everything stops except the pilot light. There is a check valve between the compressor and combustion chamber, receivers, and a throttle valve between the combustion chamber and the engine or turbine. When the throttle is opened, the engine is driven by stored pressure in the combustion chamber, supplied with combustion air from the receivers. When the engine reaches, for example 100 RPM, the unloader trips, starting the compressor pistons, and compressing air to 600 PSI to supply combustion air and replenish air used from the receivers. Combustion air is preheated by exhaust from the engine to approximately 800 degrees F after compression. A volume metering valve on the combustion air to the combustion chamber lights one or more burners to heat the volume of air required by the engine throttle valve.

10 Claims, 14 Drawing Figures

DILUTION ZONE
COMBUSTION ZONE

INVENTOR
Percy D. Hudson

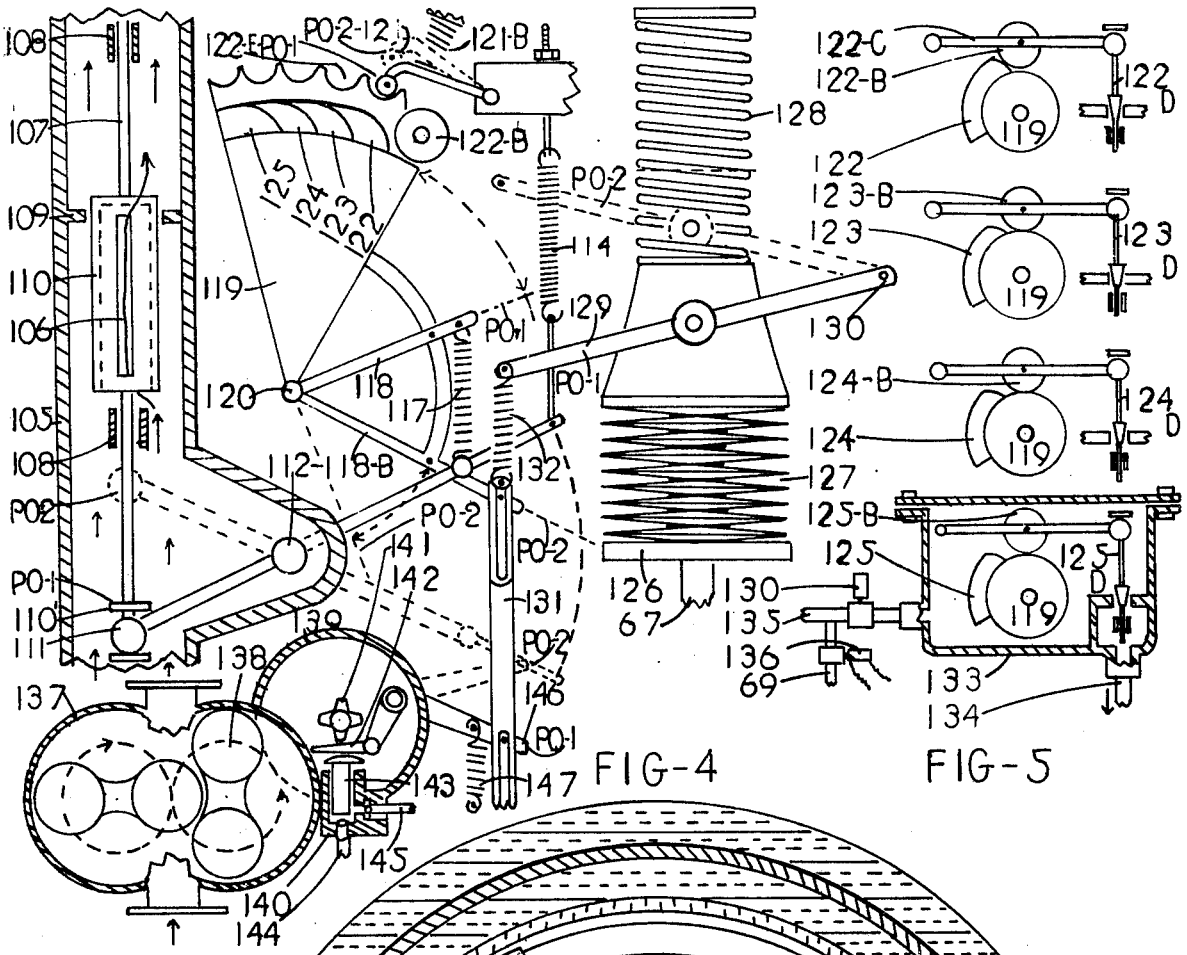
FIG-4
FIG-5
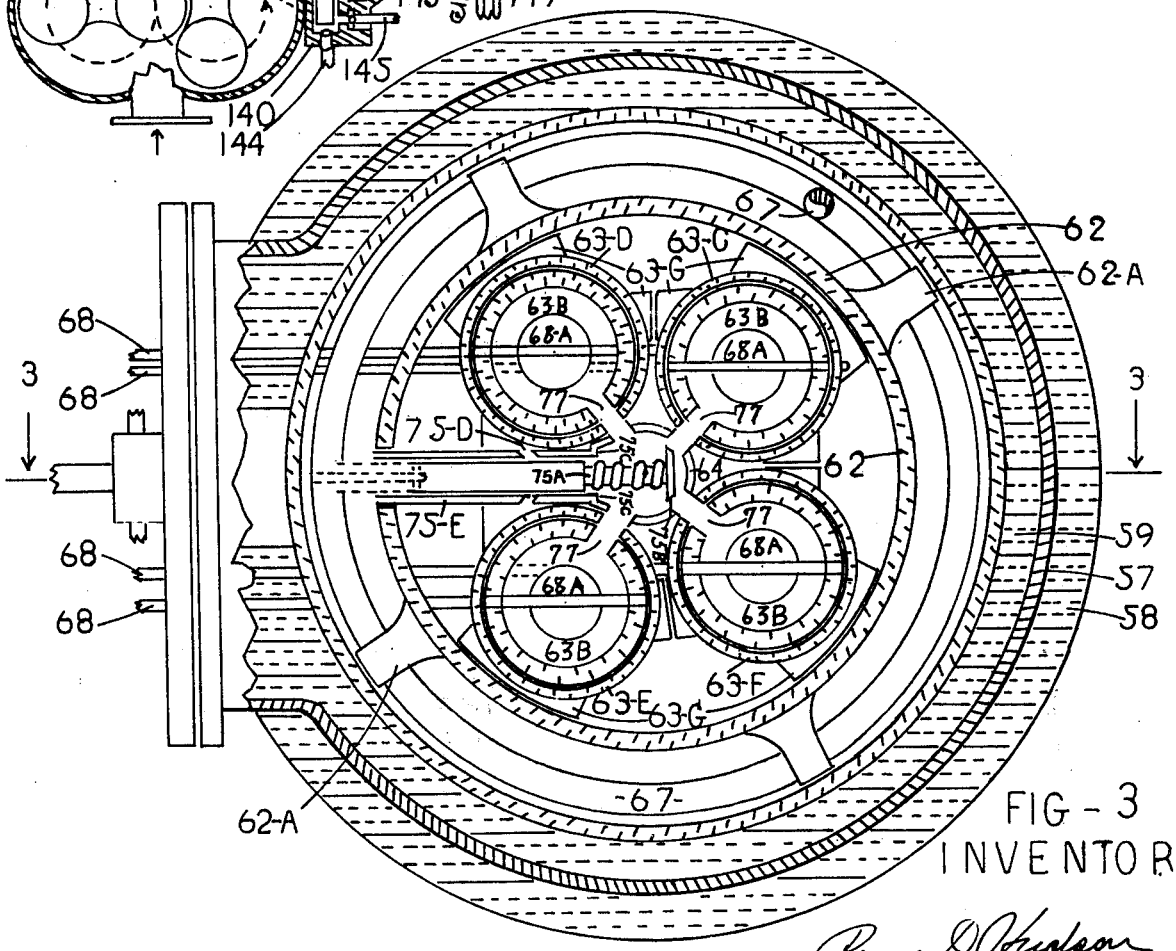
FIG - 3
INVENTOR
Percy D. Nicholson

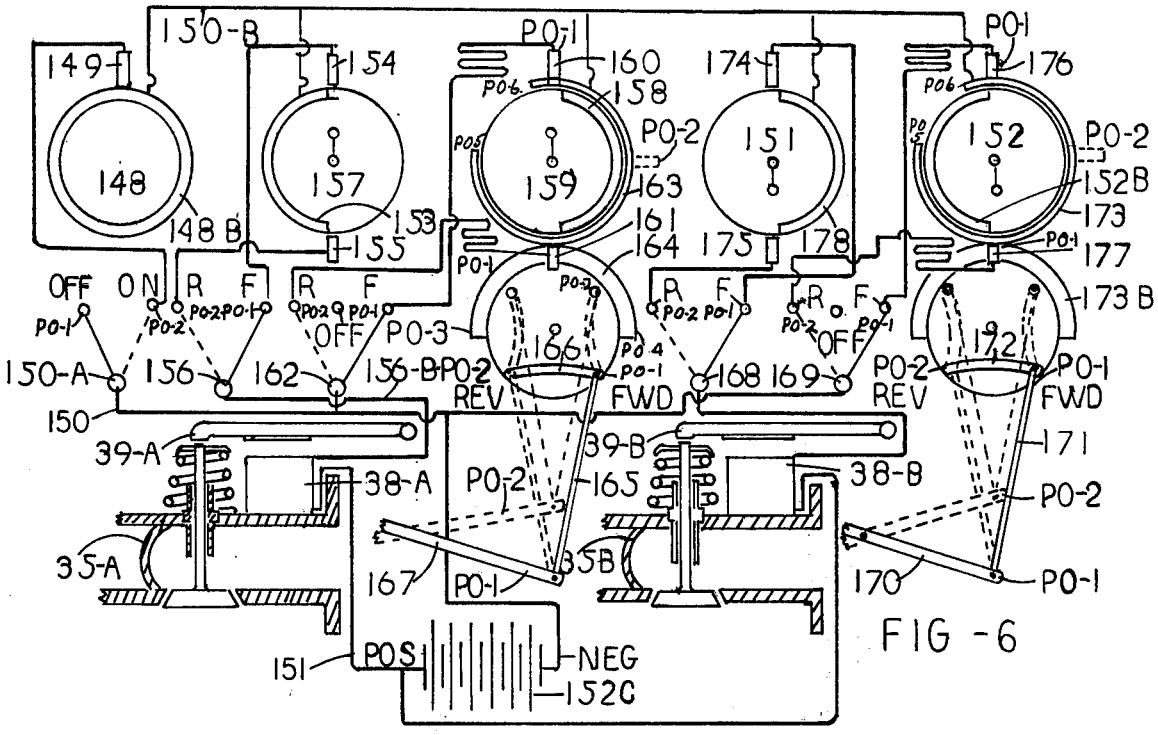
FIG -6
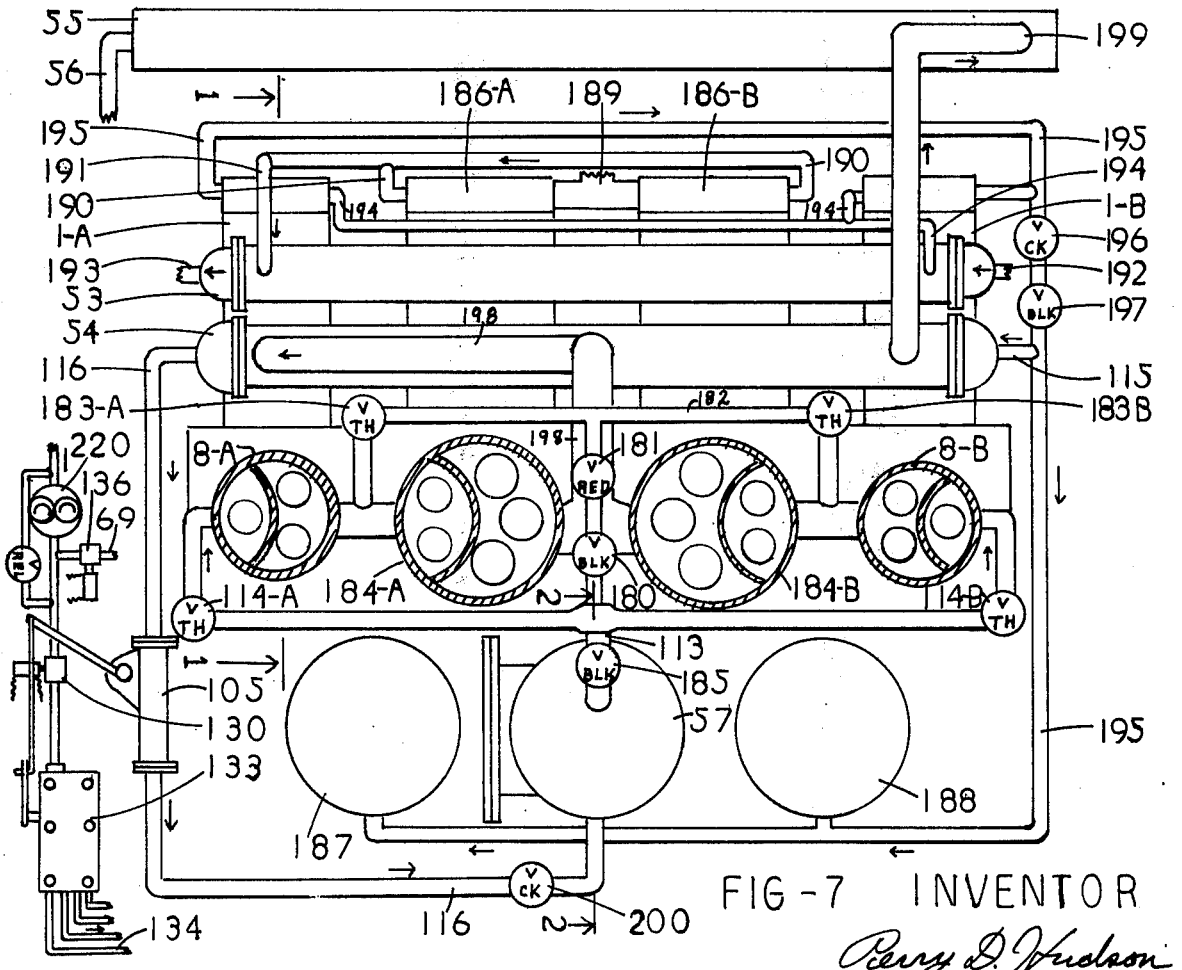
FIG-7 INVENTOR
Perry D. Hudson

INVENTOR

Perry D. Hudson

COMBUSTION PRODUCTS PRESSURE GENERATORS CONTINUOUS BURNER TYPE AND ENGINES

This invention relates to heat engines of the pressure generator or expansion chamber type, having combustion chambers separate from the power cylinders or turbine. The combustion chambers are of sufficient volume capacity to supply hot gases under pressure to the power cylinders or turbine to operate said engine or turbine several revolutions so as to give more time for complete combustion.

This invention relates to an improved combustion chamber insulated and lined with refactory material and burners of high temperature refractory material with a means of forced circulation and recirculation of the gases within said combustion chamber both through said burner and diluting the hot gases from the burners with the lower temperature gases within the combustion chamber and with the incoming combustion air.

This invention relates to an improved system of providing instant starting power, quick lighting of the pilot and burners and complete burning of the fuel, with minimal heat loss and with nearly pollution free emission combined with great fuel economy.

This invention relates to improved burners and pilot inside the combustion chamber. Multiple burners are used in the larger capacity units with a means of burning the pilot only, one burner or several burners to heat the air required by load on the prime mover. Thus each burner is used at its most efficient capacity insuring nearly perfect combustion and very little air pollution.

This invention relates to improved fuel-air ratio combined with heat control, and with instantaneous response to wide load changes, from full load to no load to stop and start again, all in a few seconds, to meet vehicle propulsion requirements of direct drive without transmission.

This invention relates to improved fuel-air ratio control by means of a positive displacement meter driving a fuel metering pump to accurately measure the fuel in ratio to flow of combustion air into the combustion chamber.

This invention relates to an improved electrical changeover system from compound operation of the engine to simple operation automatically or manually, to insure smooth, powerful operation at very low speeds or extra power when needed.

This invention relates to an improved system to cut off the flow of hot high pressure gases to the high pressure power cylinders at the precise point in the power stroke for the greatest expansion of the gases in ratio to power required.

This invention relates to a system of propulsion of vehicles without a clutch or transmission between the engine and driving wheels, combined with a system of using the compression of the engine and compressor as a running vehicle brake.

This invention relates to improved heat saving extended pistons with insulated piston heads, and extended, insulated, hot cylinder walls.

This invention relates to a cool air blocking system for the extended pistons which keeps the hot gases away from the lubricated cool cylinder walls.

This invention relates to improved pistons with insulated piston heads. These last three improvements helps cut down on the heat loss.

This invention relates to an improved V-type engine with continuous burner type combustion chamber, and heat exhanger on the exhaust to preheat the combustion air. This engine can be used with or without the cutoff system or automatic changeover from simple to compound at predetermined RPM. These engines are designed for use with slide gear or automatic transmission. It will be referred to as the number three engine.

This invention relates to an improved air fuel ratio and heat limit control system combined with an improved operating system for use with slide gear or automatic transmissions.

FIG. 1 shows a sectional view in elevation of engine 1 on section line 1—1 of FIG. 7, which shows the high pressure power cylinder with details on the construction of the extended piston, hot cylinder wall, blocking air, etc.

FIG. 2 shows a sectional view in elevation of the combustion chamber on section line 2—2 of plan view 8 and section line 3—3 of FIG. 3, showing the retractable ignitor, pilot, 4 burner plan, fan bearings, shaft seal, and blocking air arrangement.

FIG. 3 shows a plan view of the combusiton chamber shown in sectional elevation in FIG. 2 on section lines 3—3. This shows the four burner arrangement, retractable ignitor, etc.

FIG. 4 shows the volume meter, which controls the number of burners operating in ration to the volume of gases being used, and also shows the heat limit thermometer which controls the heat limit.

FIG. 5 shows the cams which turn on the burners progressively one at a time according to the volume of gases used, and also cuts off the burners one at a time as gas use volume decreases.

FIG 4 additionally shows a positive displacement meter controlling the volume of fuel pumped to the burners, maintaining the correct fuel air ratio. This can be used in conjunction with the volume meter, and heat thermometer as shown; or can be used separately.

FIG. 6 shows the electric solenoid, valve operating mechanism for the charge valves for the high pressure cylinders. This mechanism includes the "cutoff" mechanism, and the changeover means from "cutoff" compound operation to simple operation for all four of the cylinders.

Figures 1, 2, 2A:
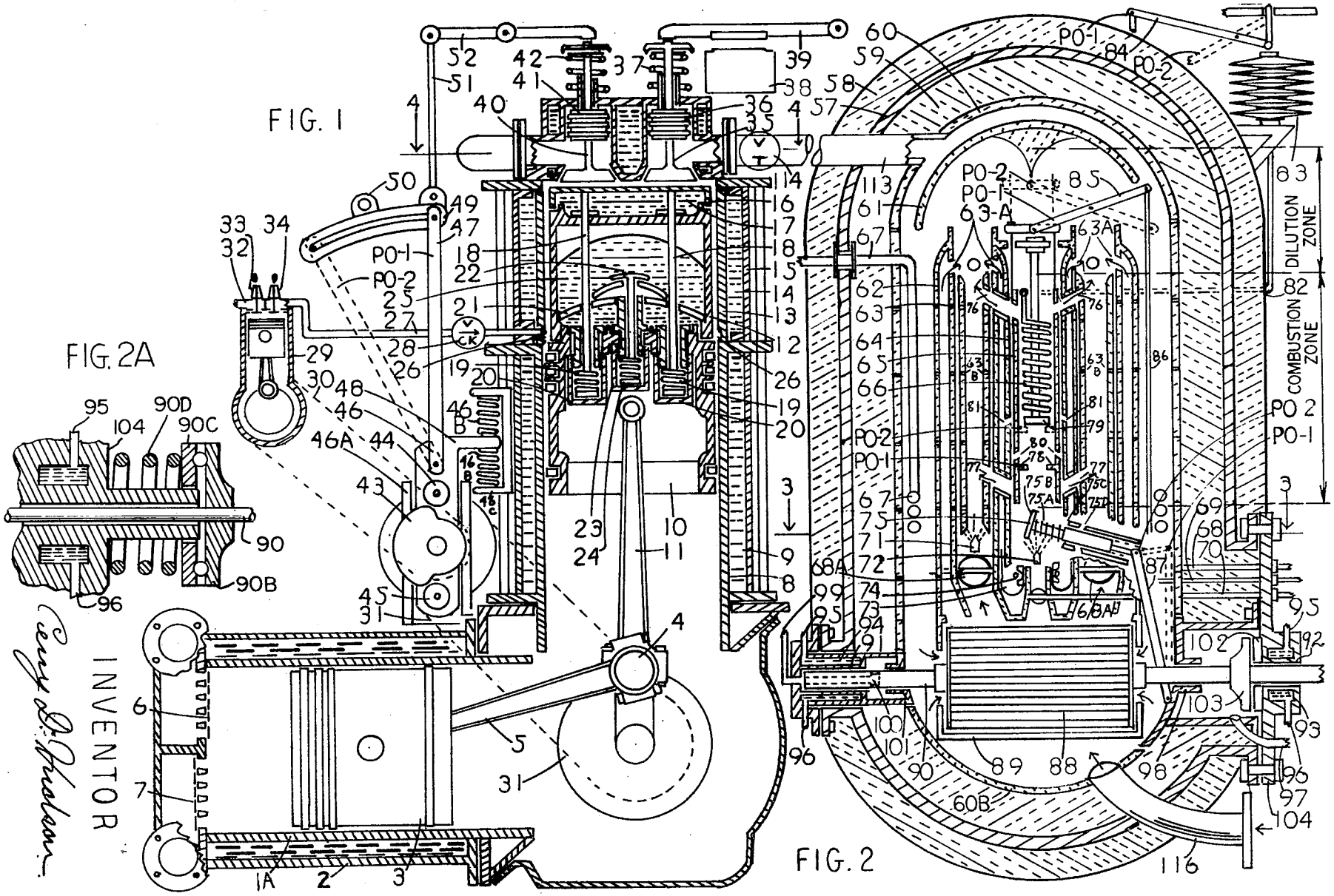
FIG. 2A shows an enlarged sectional view in elevation of the rotating seal flanges with spring bias means, as attached to the outboard section of the fan shaft 90 of FIG. 2.

FIG. 7 is a plan view of the engine shown in FIGS. 1 and 2, and general flow chart.

Figure 8:
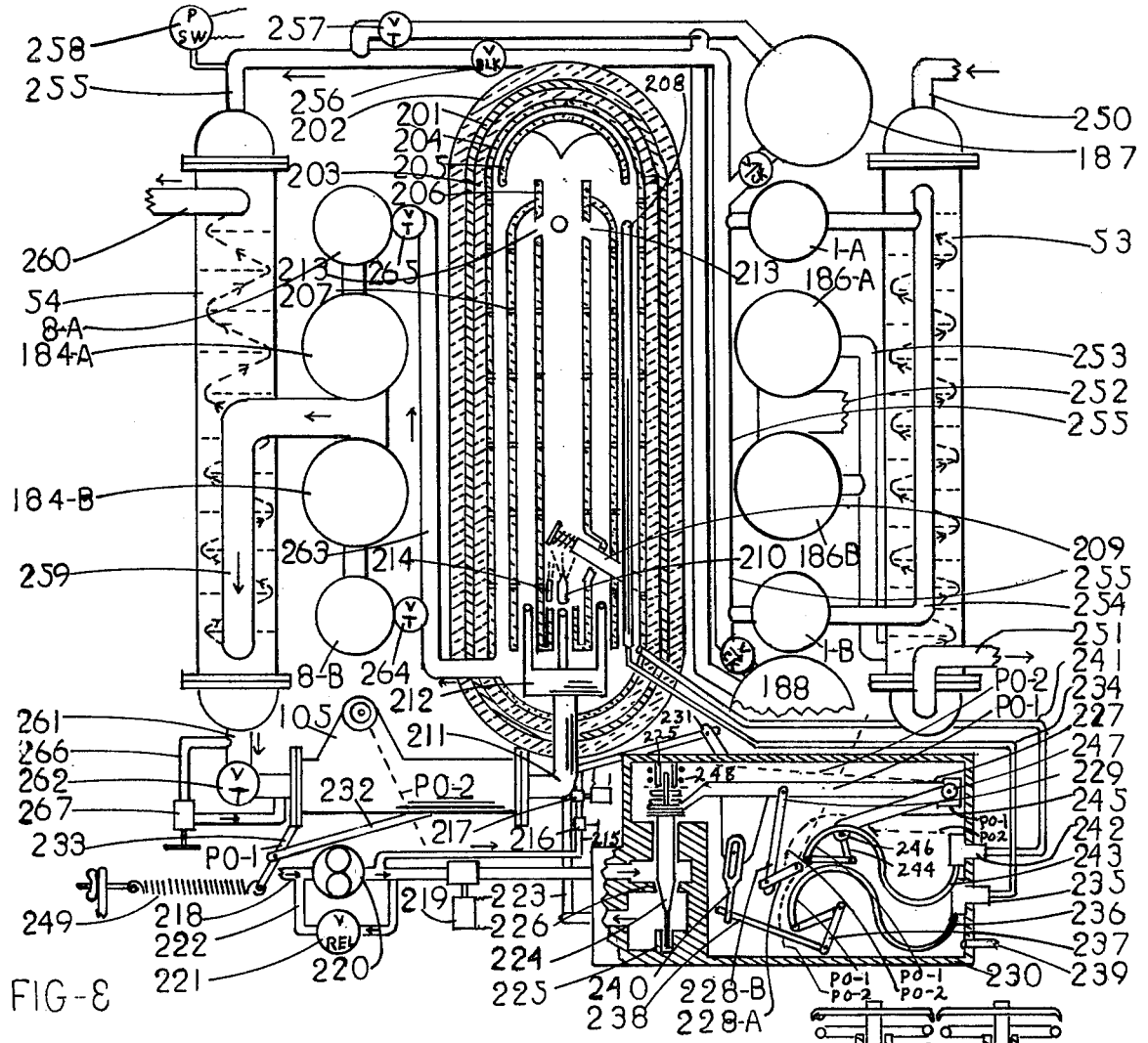

FIG.8 is a plan view of a V-type 8 cylinder engine such as is shown in FIG. 1, with a continuous type combustion chamber with a horizontal combustion chamber placed in the vee between the cylinder, designed to be used with a clutch and transmission drive shaft and rear wheel drive. The crankshaft is parallel with the length of the car.

Figure 9:
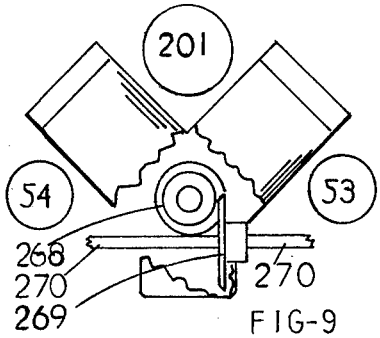

FIG. 9 is an end view in elevation of a V-type 8 cylinder engine designed to be mounted with crankshaft parallel with the length of the car, and designed to be used with a direct hypoid gear drive from the center of the crankshaft for front or rear wheel drive.

Figure 10:
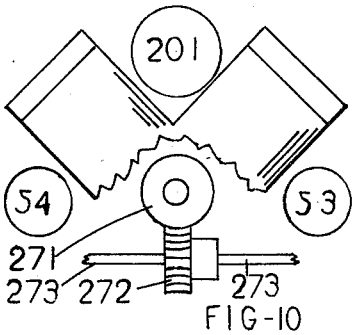

FIG. 10 is an end view in elevation of a V-type 8 cylinder engine designed to be mounted with the crankshaft parallel with the length of the car, and designed for a helical gear drive from the center of the crankshaft for front or rear wheel drive.

Figure 11:
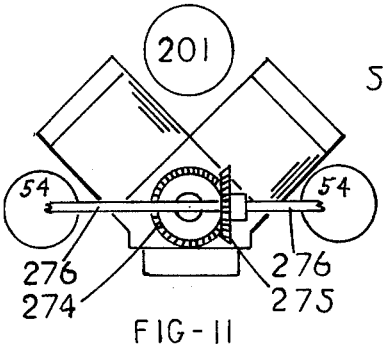

FIG. 11 is an end view in elevation of a V-type 8 cylinder engine designed to be mounted with the crankshaft parallel with the length of the car frame, and designed for a bevel gear drive for front or rear wheel drive.

Figure 12:
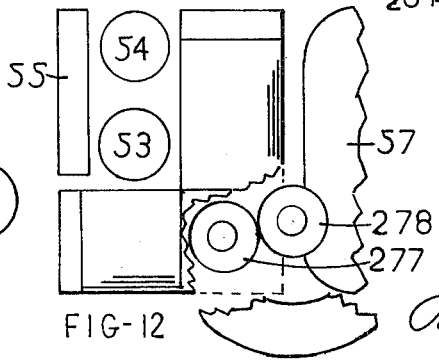

FIG. 12 is an end view in elevation of a V-type 8 cylinder engine designed to be mounted with the crankshaft at right angles to the length of the car frame, thus enabling the spur gear to be used in a direct drive to the wheels for either a front or rear wheel drive.

Figure 13:
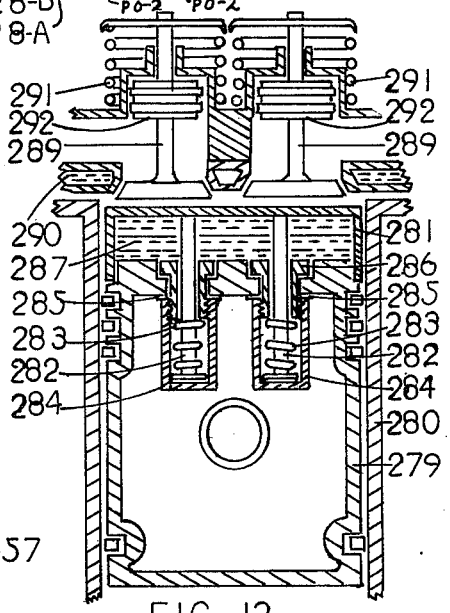

FIG. 13 is a sectional view in elevation of a "hot head" piston for use in any engine using hot gases as a pressure fluid medium. The "hot head" is insulated from the balance of the piston, thereby transmitting less heat to the piston and cylinder walls.

It should, of course, be understood that the description and drawings are illustrative merely, and various modifications and changes may be made in the structure disclosed without departing from the spirit of the invention.

Like numerals refer to like parts throughout the several views.

Referring now to the drawings, FIG. 1 is a sectional side view in elevation of one of the extended pistons for high pressure power cylinder and one of the high pressure compressor cylinders of a 4 cylinder single acting reciprocating piston engines designed to operate on hot combustion products gases. Referring to the compressor, 1 is the cylinder, 2 is the cylinder cooling liquid jacket, 3 is the compressor piston connected to crankshaft 4 by connecting rod 5. The compressor intake valve is 6, the outlet valve is 7, both flat reed type valves. The power cylinder is 8, with cooling liquid jacket 9. The power piston 10 is connected to the crankshaft by connecting rod 11. The extension on the hot head piston 12 and hot cylinder wall 13 are insulated by insulation 14 from the outer pressure holding cylinder wall 15. The hot head piston head 16 is insulated by insulation 17 from piston extension 12 and is secured by bolts 18 to power piston 10, tensioned by stiff holding springs 19, and sealed pressure tight by cap 20. Circular clamp 21, pressured by bolt 22, holds the hot head piston extension secured and centered to power piston 10 by tension spring 23 and sealed pressure tight by cap 24 and insulated by insulation 25 from piston 10. Hot cylinder wall 13 has a blocking air distributor groove 26 all the way around the bottom. Said groove is in communication with blocking air conduct 27 via check valve 28 and supplied by blocking air metering mechanism 29. This metering mechanism consists of a small reciprocating piston compressor driven at engine crankshaft speed by silent chain 30 from the camshaft, which is driven at crankshaft speed by silent chain 31 from the main engine crankshaft.

This metering mechanism is supplied with cool 600 PSI air from the main compressor 1. The operation of the extended hot head piston and blocking air will now be described. This piston is designed to keep the hot gases away from the main pressure sealing piston 10 and the lubricated cylinder wall 8, and to conserve the heat in the hot gases. The piston extension 12 clears the hot cylinder wall 13 by 0.0010 to 0.0040 thousandths of an inch. Cylinder wall 13 is insulated from outer pressure holding cylinder wall 15 by insulation 14 and is fit to allow for vertical and radial expansion when hot. The compression of holding springs 19 and 23 holds the piston extension and hot head fast to main piston, but allows for vertical and radial expansion. Clamp 21 and holding bolt 22 hold it centered with main pressure sealing power piston 10. The blocking air compressor and metering device 29 is driven at crankshaft speed and in exact time with the crankshaft by silent chain 30 off of the camshaft, which is driven at crankshaft speed by silent chain 31, FIG. 1.

The volume capacity of the blocking air piston in compressor 29 is the same or slightly more than the volume capacity of the 0.0010 to 0.0040 thousandths clearance between the hot cylinder wall 13 and hot piston extension 12. As the piston 10 travels on the exhaust stroke; the clearance space between the piston extension walls and cylinder walls is filled with cool blocking air at 600 PSI, or less, so when high pressure charge valve 35, FIG. 1, opens, the hot gases cannot go into the clearance space. As piston 10 goes down on the power stroke, the hot gases above the piston hold the cool gases in the clearance space. On the upward exhaust stroke, the air in the clearance space if forced out by the fresh charge of blocking air. Thus, since the hot gases come in contact only with the hot cylinder wall 13 and hot piston head 16, very little heat is lost. Air is supplied to air blocking compressor via inlet 32 through mechanical cam operated inlet valve 33 and discharge through valve 34. Air is supplied from high pressure compressor line 195, FIG. 8. The high pressure gases are admitted to the high pressure power cylinder by valve 35, which is balanced by piston 36 and closed by spring 37. Valve 35 is opened by electric solenoid 38 via lever 39. The electrical valve operating mechanism is described later.

Exhaust valve 40 is balanced by piston 41, closed by spring 42, and is operated by cam 43. Can 43 strikes rollers 44 and 45, which are rotatably secured to cam follower slide 46. Slide 46 slides in guide 46A, which is moveably secured to a push rod 47 slideably attached to rocking reverse quadrant 49, which is pivoted on pin 50. This motion, transmitted via push rod 51 and rocker arm 52, opens and closes exhaust valve 40. When push rod 47 is in PO-1 (position 1), the valve is operated for clockwise rotation of the engine. When push rod 47 is in PO-2 (position 2) on rocking reverse quadrant 49, the valve is operated for counter clockwise rotation of the engine. The top part of the cam follower slide has an arm 48 extending to the right and engaging light springs 46B, which are held by bracket 46C. These springs return cam follower 46 to a center or "neutral" position after the valve is closed. This is required, as cam 43 pushes rollers 44 and 45 both up and down in each rotation. The downward motion on clockwise rotation of the engine just swings rocker arm 52 up away from the valve. However, with push 47 in PO-2 in reversing quadrant 49 for counter clockwise of the engine, this downward motion would open exhaust valve 40.

The interstage cooler for the compressor is 53. The air preheater or regenerator is 54. The air cooled exhaust condenser is 55. The condensate drain to the holding tank is 56, (holding tank now shown).

Describing FIG. 2, which is the combustion products combustion chamber or expansion chamber 57, which is a strong pressure vessel, the outside insulation is 58 and the inside insulation is 59; the sectional refactory lining is 60. The flame diverter is 61. The sectional outside burner jacket is 62. The spacing legs on sectional burner jacket are 62 and 62A. The sectional lining for the burners is 63B, FIGS. 2 and 3. This lining is made of very high temperature refactory material.

When starting switch is turned on, this opens solenoid valve 136, FIGS. 5 and 7, through which fuel is supplied to pilot spray nozzle 72, FIG. 2, and turns on and extends the ignitor. The outer pilot tube is 64. The inner pilot tube 65, which is one piece of heat resistant material, is moved from PO-1 to PO-2 by heat from the pilot via thermostatic element 66. This action will be described later. The thermostatic element 67 powers the fuel air ratio and heat limit controls 126, FIG. 4. The air damper control rods to the main burners are 68. The air damper control rod to the pilot is 70, FIGS. 2 and 3. The fuel line to the pilot is 69.

The fuel spray nozzle for one of the four burners is 71. The fuel spray nozzle for the pilot is 72. The catch basin for the pilot spill is 73. The alternate pilot ignitor is an electric glow coil 74 which is mounted in an insulating ceramic ring. If the pilot did not light from the main ignitor 75, the fuel sprayed from the pilot spray nozzle would run down into catch basin 73 and be ignited by glow coil 74. When first lighted, the pilot light flame passes around thermostatic pipe coil 66 and out openings 76 into main burners 63. Element 66 will get hot quickly, vaporizing the liquid within the coil, and via tube 82, put pressure on bellows 83, expanding it to PO-2. This movement, via linkage 84 – 85, moves inner pilot tube 65 up to PO-2, closing opening 76 and opening the openings 77, directing the flames into each of the four burner tubes through openings 77, FIG. 2. This upward movement of the pilot tube 65 from PO-1 to PO-2 brings shoulder 78 up against the ceramic head of coil holder 79, sealing the coil chamber off from the flame of the pilot. In PO-2, the air holes 80 in the inner pilot tube 65 match with air holes 81 in the outer stationary pilot burner tube 64, letting cooler air from the fan circulate through coil 66. This movement, via the linkage from lever 84, also cuts off the electric power to the igniters 74 and 75A and closes a switch which opens solenoid valve 130, FIG. 5, admitting fuel under pressure to the main burner control box 133. This movement also, via linkage 84 – 85 – 86 and lever 87, retracts main igniter 75 from PO-1 to PO-2. In PO-2, ceramic head 75B closes off the opening 75C and opens air holes 75D from the burner jacket, letting the cooler air from the fan circulate around igniter coil 75A. Thus the thermostatic coil 66 and the main igniter coil 75A are protected from the flame and heat of the pilot burner after ignition takes place.

The circulating fan 88 is housed in case 89 and turns on shaft 90 in bearings 91 and 92 which are cooled by cooling liquid jackets 93 and 94, circulating coolant through cooling liquid inlets 95 and outlets 96. With blocking air going through inlet 97 and venting into the combustion chamber around loosely fit bearing 98, and blocking air going into inlet 99 and through drilled opening 100 in shaft 90 and venting into the combustion chamber through loosely fit bearing 101, this blocking air keeps the 1600° F gases in the combustion chamber away from the bearings and seal 103. Seal 103 is a hard polished flange secured to shaft 90 in a pressure tight joint, working against softer disc 102 of antifriction material secured pressure tight to the large head 104, which is removable for access to the fan and burner assembly. Fan shaft 90, FIG. 2A, has a thrust bearing 90C and thrust flange 90B removeably attached thereto, outside the head 104. The compression spring 90D produces an axial thrust against thrust bearing 90B, which moves hard polished flange 103 against softer seal disc 102 and produces a rotating, slideable, pressure seal with said matching seal flange. The main combustion air inlet is 116. The main hot combustion products gases outlet to the engine is 113.

FIG. 3 is a cross section plan view of the combustion chamber shown in FIG. 2. This view shows a four burner assembly with a pilot in the middle, and igniter tubes 77 communicating with all four burner tubes shown in FIG. 2. Also shown is a larger view of pilot tube 64 and electric hot coil igniter 75A. FIG. 3 shows a clearer view of how the igniter head 75B fits against shoulder 75C, sealing off the igniter from the flame and heat from the pilot. Also it shows the outer burner air jacket 62, which encloses all the burners for cooling air to the outside of the burner tubes 63 — 63 — 63 — 63 and dilution of the hot gas from the burners via aperatures 63A FIG. 2. It shows the positioning legs 63G on burner tubes 63. It shows the holes 75D in the outer pilot guide tube 75E, which circulates the cooler air around the heating element 75A when it is retracted to PO-2, FIG. 2. It also shows the sectional high temperature refactory material burner liners 63B. These liners take the high heat necessary to make a clean burn and cut down on ar pollution.

FIG. 4 shows the fuel-air ratio and heat control. The air flow meter is 105. The heat control 126 works to keep the heat in the combustion chamber at 1,600° F, yet limits it to 1,600° F. FIG. 5 shows the fuel control unit with the cams, rollers, and fuel vaves separated for easier illustration. The control box is shown in elevation section as 133. The camshaft 120 carries all the cams 122, 123, 124 and 125. The cam 122 strikes cam roller 122B which, via lever 122C, opens valve 122D and lets the fuel flow to burner 63C, then to the burners 63D, 63E and 63F, or the number of burners needed, until required heat is supplied to combustion air. Each burner has a separate cam roller and valve with a separate fuel line to each burner. The fuel line to burner 63F is shown as 134. The heat control unit 126, FIG. 4, is powered by thermostatic element 67, FIGS. 2 and 3, inside the combustion chamber. The gas expands when heated, and expands metal bellows 127 from PO-1 to PO-2. When it approaches PO-2, lever 129, pivoted on pin 130, takes the slack out of link 131 and puts upward pressure on spring 132, urging lever 118B toward PO-1. Spring 128, balanced against the gas pressure, is calibrated to push cam 119 back to PO-1 when temperature within the combustion chamber reaches 1,600° F, thus shutting off the burners.

The outside case of the air flow metering mechanism is 105. The flow measuring piston is 106, which is supported on guide rod 107 and is guided by guides 108. Stationary shoulder 109 fits piston 106 with a small clearance. Piston 106 is a hollow cylinder closed at the top and open at the bottom, and has slots in the sides 110. The air fow to the combustion chamber connection 104 is up as indicated. PO-1 corresponds to no flow fuel to the burners, and only pilot burning. When the throttle to egine 114, FIGS. 2 and 7, is opened, the pressure inside the combustion chamber 57 is reduced. This starts the flow of combustion air coming from the compressor and/or the receivers through lines 113, 115, 116, and 195, FIGS. 2 and 7, into fow meter 105 from the top downward, through flow measuring piston 106 and out slots 110. Piston 106 moves upward from PO-1 toward PO-2 until the pressure equalizes above piston 106 with the pressure below piston 106 by opening more of slots 110 above shoulder 109 for the air to flow through. When the flow slackens spring, 114 and the weight of piston 106 pushes the piston down toward PO-1. The flow increase moves piston 106 up; this movement, transmitted by flanges 110 on vave guide rod 107. This moves lever 111 up towards PO-2, pivoting at 112, and passes out through moveable pressure seal; moves lever 111 outside of flow meter body 105 downward which, via spring 117, pulls lever 118 and cam quadrant 119, pivoted on pivot 120, down toward PO-2 from PO-1. Cam quadrant 119 is a schematic view, enlarged for better illustration, representing the cams 122, 123, 124 and 125 shown in FIG. 5. The movement of cam quadrant 119 and levers 118 and 118B (which are integral with quadrant 119) is from PO-1 toward PO-2, FIGS. 4 and 5. Cam 122 first strikes cam follower roller 122B and opens valve 122D, lighting burner 63C, FIG. 3. Positioner roller 121, FIG. 4, is pressured by spring 121B, which tries to hold it in notches 122E. This makes the pressure from flow valve piston 106 overcome spring 121B and let positioner roller 121 fall into notch 122E. This makes the movement of cam quadrant 119 in steps. Thus it makes a step action in turning the burners 63C, D, E and F on or off a distinct step operation. Thus the increase of the flow of air to the combustion chamber turns the burners on one at a time. A decrease in the flow of air through flow valve 105 cuts off the burners one at a time. The burners are set for maximum efficiency as to air and fuel flows. Thus each burner operates at full capacity and efficiency and makes a clean burn of fuel.

FIG. 4 shows a positive displacement fluid meter which measures the amount of air going to the combustion chamber via flow meter mechanism 105 and air pipe line 116, FIG. 7. Also it supplies power to drive variable feed fuel metering pump 140 via gears 138 and 139 which drives cam 141 which via wedge shaped cam follower 142, drives fuel pump piston 143. Piston 143 pumps fuel from fuel supply line 144 and forces it out through fuel line 145 to burner control unit 133 via fuel line 135, FIG. 5. When gases within the combustion chamber heat thermostatic element 67 to, for example 1600° F, and diaphragm unit 127 expands from PO-1 to PO-2, this movement via lever 129 and rod 131, moves variable fuel feed lever from PO-1 to PO-2. This decreases the amount of fuel supplied to the burners in the combustion chamber. Spring 147 returns lever 146 to PO-1. Rotation and flow direction are indicated by arrows. Either type of flow meter may be used separately or used together in coordination as shown, to control the fuel-air ratio and heat. The preferred control and burner arrangement is as shown in FIGS. 2, 3, 4, and 5.

FIG. 6 shows a schematic view of the electrically operated valve operating system for the high pressure cylinders. This system gives the option of either a forward or reverse operation of the engine using full throttle control of a 4 cylinder simple engine operation, or a variable cut off point from valves not opening at all to 50 percent of the power stroke with the high pressure cylinders exhausting into the low pressure cylinder in a full compound operation. The compound operation uses the variable cut off instead of the throttle to control speed of engine. This system is instantly convertible from simple to compound and back to simple with the engine running full speed.

The electrical contact drum or commutator (sectionalized for better illusttation) consists of a round drum of non-conductor material long enough for five separate electrical contact rings. This drum rotates at crankshaft speed. The metal electric contact segments are inlaid into and secured in much the same manner as the commutator on a slip ring electric motor. The segments are spaced in exact relationship to the position of the engine crank on the cylinder served. The inlaid segments are connected to each other by circuit 150B and to the "ground" control ring 148B, which segment is all the way around the drum and makes continuous contact with an electric contact carbon brush 149, which has an electric off and on switch 150A.

The OFF position of switch 150A means that the cutoff to the valves is in operation, and the engine is operating as a compound engine.

The ON position of switch 150A means that the cutoff is not in operation, and the charge valves to the high pressure cylinders are open, the full power stroke is 180°, and the engine is in "simple" operation on all four power cylinders.

The segment 153 in contact ring goes only 180° of the circle and has an electric contact brush 154 for forward or clockwise rotation of the engine. Contact brush 155 is for counter clockwise rotation and is connected to the reverse side of reversing switch 156 which is marked F for forward or clockwise rotation odf the engine, and marked R for reverse for counter clockwise rotation of engine. The ⊖ symbol in the center indicates position of engine crank as to top dead center in relation to the segments in the contact ring. The metal electric contact segment of contact ring 158 only goes 180° of the circle. The crank position in relation to the segment is shown as 159. The forward contact brush is 160. The reverse brush is 161. These brushes are connected by flexable conductor cords to reversing switch 162. Contact brushes 160 and 161 are mounted on an oscilating carrier 163 which has a spur gear for 200° from PO-5 to PO-6, which engages a spur gear on reversing quadrant 164 which has a spur gear. 200° from PO-3 to PO-4. When cutoff operating rod 165 is in PO-1 in slide 166 and is moved upward from PO-1 or off to PO-2 by cutoff operating lever 167, this rotates the brush carrier 163 clockwise bringing brush 160 to PO-2 so that segment 158 and crankshaft turns 90° clockwise before contact is broken between brush 160 and segment 158. When this contact is broken, valve 35 closes.

The battery or other source of electric current is 152. The positive side is connected to one lead wire of electro magnet solenoids 38A and 38B, which operate pressure inlet valves 35A and 35B, FIG. 6, via arm 39 - lever. The negative lead of the battery is connected to switches 150A, 162 and 169. The switches 150A is in PO-1 or off and switches 156, 162, 168 and 169 are all in PO-1 or clockwise rotation position. The circuit for 38A electro solenoid magnet is through switch 156 to brush 154. When crank 157 is 5° past center segment 153, it comes in contact with brush 154. This completes the circuit via conductor 150B to segment 158 track 159. When brush carrier 163 is in PO-1, there is no contact between segment 158 and and brush 160. If the brush carrier is in any position between PO-1 and PO-2, then brush 160 is in contact with segment 158. This would complete the circuit with current from battery 152 flowing through the conductor 156B, through switch 156, to brush 154, which is in contact with segment 153. As segment 153, via conductor 150B (which is inside the control spool), is connected to segment 158 which is in contact with brush 160, then through switch 162 to the negative post of battery 152, the circuit is closed, with magnetizing magnet 38 opening valve 35. When segment 158 breaks contact with brush 160, the circuit is broken, and valve spring 37 closes valve 35. Thus with lever 167 in PO-1, valve 35 would not open at all as segment 158 would be past brush 160 before segment 153 made contact with brush 154. But, if brush holder 163 was turned clockwise, say 25°, brush 160 would stay in contact with segment 158 until 25° after top dead center, at which time contact would be broken between brush 160 and segment 158, closing valve 35. Thus, in cutoff operation, the position of brush 160 between PO-1 or PO-2 would govern the amount of pressure fluid medium admitted to the cylinders, thereby governing the speed and power of the engine. The throttle lever, accelerator pedal, or governor, would control the position of levers 160 and 170.

To reverse the engine the electric switches 156, 162, 168, and 169 are placed in PO-2, and levers 165 and 171 are moved from PO-1 to PO-2 in reverse quadrants 166 and 172. This energizes contact brush 155 on contact track 157, brush 161 on track 159, brush 175 on track 151, and brush 177 on track 152B.

Describing the action of track 159, in PO-1 contact brush 161 is not contacting segment 158, hence valve 35A is closed. But, if cutoff operating lever 167 is moved from PO-1 to PO-2, this would turn oscillating brush holder 163 counter clockwise 90°, thus placing contact brush 161 in PO-2 so that brush 161 would contact segment 158 until crank 159 had reached side center 90° or 50 percent of the power stroke. Any position of lever 167 between PO-1 and PO-2 would open valve 35A at that position.

To take the cutoff out of operation and change to simple operation on all four cylinders during clockwise rotation, switch 150 A is moved to ON on PO-2 and switches 162 and 169 are moved to center or off positions. Thus, the circuit is from the negative side of the battery through switch 150A into contact segment 148B via brush 149 to circuit 150B inside the contact drum which connects all contact tracks together; thence to contact track 157 and to segment 153 to brush 154, thence through electro magnet 38A to the position side of the battery. Thus on track 157, anytime contact brush 154 is in contact with segment 153 valve 35 would be open the full 90° of the stroke of the piston on clockwise rotation. On counter clockwise rotation, switches 156 and 168 would be in PO-2, so contact brushes 155 or 175 would be in contact with segments 153 or 178. When the cutoff is taken out of operation by moving switch 150A to PO-2, this movement also opens solenoid operated block valve 180, FIG. 7, admitting 600 PSI gases to flow through pressure reducing valve 181 and pressuring manifold 182 to say 100 PSI. This pressure to the low pressure cylinders 184A – 184B is controlled by throttle valves 183A – 183B. The 600 PSI gases to the high pressure cylinders 8A – 8B are controlled by throttle valves 114A and 114B. These four throttle valve operating linkages are all connected together to operate as one on the simple engine operation. On compound engine operation only the 114A – 114B throttle valves operate. These are linked with the cutoff control levers 167 and 170 so as to stay open enough so that the incoming gases are not throttled enought to reduce the pressure to the high pressure inlet valves 35A – 35B. When the engine operation is changed to simple, the throttle valves 114A – 114B and 183A – 183B close down to take full control of the engine operation. The advantage of switching to simple operation at low speeds or starting up cold is that it gives power to the big low pressure cylinders 184A, 184B, FIG. 7, to move a heavy load from a standing start smoothly and with great power. As soon as the engine has reached 100 to 200 RPM, then the engine operation can be changed to a compound operation either manually or automatically. This is a great advantage when the engine is connected to drive the wheels of a vehicle at or near the speed of the engine without a clutch or transmission. It gives you a "low gear" or leverage to smoothly start a heavy load from a standing start.

FIG. 7 is a schematic plan view, partly in section, showing the power cylinder heads cut on section line 4 – 4, FIG. 1, showing the intake and exhaust valves of the power cylinders. The high pressure power cylinders are 8A and 8B. The low pressure power cylinders are 184A and 184B. The two high pressure compressor cylinders are 1A and 1B. The two low pressure compressor cylinders are 186A and 186B. The air compressor interstage cooler is 53. The combustion air preheater is 54 which uses the exhaust to preheat the combustion air after compression. The exhaust gas condenser is 55, and the gas and liquid outlet is 56. The liquid goes to a holding tank (not shown) to be drained at intervals. If the chemical content is high enough, it could be collected at the service stations and sent to a chemical plant for reclaiming contents. Condensing the exhaust should reduce the emissions greatly.

The combustion products expansion chamber is 57, shown in section in FIGS. 2 and 3. The air storage receivers are 187 and 188. The intake to the low pressure compressor cylinders is 189. The outlets 190 are connected to line 191, which goes to the shell side of the interstage cooler 53. The cooling medium inlet is 192 and outlet 193. The air then passes around the tubes filled with cooling medium and out on the right hand end in line 194, thence to the intakes of the high pressure compressor cylinders 1A and 1B; then out the discharges of cylinders 1A and 1B into line 195. It then passes through check valve 196 and block valve 197 and into line 115 into the tube side of the air preheater exchanger 54. The hot exhaust from low pressure cylinders 184A and 184B passes into manifold 198 into the left hand end of the shell side of exchanger 54 through baffles and out exhaust line 199 to exhaust condenser 55. The combustion air passes through the tubes of the exchanger from right to left, in counter flow to the hot exhaust heating the air to approximately 800° F, thence through line 116 and check valve 200 into the bottom of combustion chamber 57 through inlet 116 FIG. 2. Line 195 extends around to air receivers 187 and 188. These receivers float on the line holding 600PSI on the combustion chamber at all times. This acts as a reserve of air for sudden demands for lots of power over a short period of time. Also, when the engine is shut down and the solenoid or other servo means is operated, block valves 180, 185, and 197 are closed. This considerable supply of air in the combustion chamber, with two air receivers and preheater tubes, is sufficient to operate the engine for several minutes from a cold start while pilot and burners are lighting up and getting hot, and the engine has attained enough RPM for the compressor to start operating. The receivers can be located some distance from the engine in a convenient location. In an automobile there is space in back of the back seat. With front end drive and a dropped center rear axle, there would be considerable room back of the back seat for air receiver, with the connecting line running beneath the floor boards to the combustion chamber.

Engine number 3, FIG. 8, shows a schematic plan view of a V-type 8 cylinder engine with a somewhat different combustion chamber. Th circulation and recirculation principle is retained, but without a fan inside the combustion chamber. The combustion chamber is 201. The outside insulation is 202. The inside insulation is 203. The inside liner of heat resistant material is 204. The flame diverter of refactory material is 205. The inner tublar burner shell is 206. The tublar outer air jacket for the burner shell is 207. The thermostatic element for air fuel ratio and heat control is 208. The retractable electic igniter is 209. The burner spray nozzle is 210. The combustion air inlet is 211. The combustion air distributor header is 212. This header has three nozzles, the combustion air nozzle in the center extends up inside the burner tube 206 a short distance. The two outside nozzles extend up into the burner air jacket 207 a short distance. This produces a injector or syphon action pulling in and recirculating the gases inside the combustion chamber. The gases in the burner jacket mix with the hot gases of combustion from the burner 206 through aperatures 213, thus diluting the hot gases to a workable temperture. The pilot light spray nozzle is 214, supplied by line 215, regulated by throttle valve 216 and solenoid operated block valve 217. The manifold supply line is 218, controlled by solenoid operated block valve 219. Pump 220 supplies fuel pressure to the burner nozzle 210, flow to which is controlled by needle valve 224 which is guided by guides 225 and seats on seat 226. Needle valve 224 is controlled by lever 227 which is moved by lever 228A via connecting rod 228B. Lever 228A is on a shaft which extends through the outer wall of housing 230 and is connected to lever 231. This, via connecting rod 232, is connected and moved by lever 233 of flow metering valve 105, FIGS. 4 and 8. The action of valve 105 is the same as that previously recited. The burner illustrated in FIG. 8 shows only one burner, but multiple burners and controls, as shown in FIGS. 2, 4, 5, and 6, may be used.

Explaining further the fuel air-ratio controls, the volume of air passing through flow metering valve 105, moves lever 233 from PO-2. This movement, via rod 232 and lever 231, moves lever 228A, and via link 228B, moves lever 227 from PO-1 toward PO-2, which opens needle valve 224, allowing fuel to flow to the burner nozzle 210 where it is ignited by pilot 214 and is supplied combustion air by the burner nozzle via line 211. The fuel-air ratio unit has two compensating devices. Thermostatic element 208 is connected to expansive unit 235 by line 234. As heat is generated to the predetermined degree in combustion chamber 201, the gas within thermostatic element 208 expands and causes expansive tube 236 to move from PO-1 toward PO-2. This movement, via linkage, moves lever 237 and link 238 and 240 to lever 227, restrains it, and brings lever 227 back toward PO-1, cutting down on the flow of fuel to burner 206, thus controlling the temperature in combustion chamber 201. The second compensating device measures the air pressure in combustion chamber 201 and limits the amount of fuel in ratio to the pressure in combustion chamber 201. Line 241 connects the combustion chamber 201 to expansive element 242 and expansive tube 243. An increase in pressure in combustion chamber 201 moves tube 243 from PO-1 to PO-2 via linkage lever 245 pivoted on pivot 246 to move lever 227 secured to it by pin 247 from PO-1 to PO-2. Thus an increase in air pressure is combustion chamber 201 via the linkage just described, opens needle valve 224 to give the burner more fuel. If air pressure decreases in combustion chamber 201, expansive element 243 plus springs 248 and 249 closes needle valve 226 to the point at which the proper fuel-air ratio is reached. This fuel ratio to air pressure compensating device can be used with controls shown in FIGS. 4, 5, and 6 with single multiple burners. The drain for fuel leakage to return to fuel tank is 239.

The compressor air intake is 252, which goes into low pressure air compressor cylinder 186A – 186B, out the discharge valves, into low pressure manifold 253, into the shell side of inter stage cooler 53, flows around the baffles and tubes as indicated by the dotted lines, out into high pressure compressor intake manifold 254, and into the intakes of high pressure compressor cylinders 1A and 1B. The interstage cooler cooling liquid line into the exchanger is 250, and the outlet is 251; thence into high pressure air line 255, which is connected to air storage receivers 187 – 188 with check valves in the line to let the high pressure air into the receivers, but not out. Line 255 is connected to the tube side of air preheater 54. The hot exhaust from low pressure power cylinders 184A and 184B goes into exhaust manifold 259, which is connected to the shell side of preheater 54 as shown. The hot exhaust travels around the tubes and baffles as shown by dotted lines and out exhaust line 260 to a condenser or to the atmosphere. The air heated to approximately 800° F comes from the preheater in line 261 through throttle valve 262 into air flow meter 105, through line 211, and into the combustion chamber 201, where it is heated to approximately 1600° F, then into high pressure manifold 263, and into high pressure power cylinders 8A and 8B, controlled by throttle valves 264 and 265.

I filed an application for U.S. Pat. on May 4, 1970, application No. 36,304, covering among other engines a 4 cylinder double acting reversing engine with cut off and changer over from simple to compound using combustion products pressure generators to furnish the pressure fluid medium. This engine was designed for vehicle propulsion, and is referred to as the number 1 engine.

The engine and combustion products expansion chamber with continuous burner, shown in FIGS. 1, 2, 3, 4, 5, 6, and 7 herein, which is designed for vehicle propulsion, is referred to as the number 2 engine.

The engine shown in FIG. 8, having a somewhat different expansion chamber, and no cutoff or reversing gear, is referred to as the number 3 engine. The engine 3 can be used with a transmission for vehicle propulsion. Engine 3 can be used with many kinds of control systems and methods of operation according to power requirements, etc. I will now describe two methods of operation where this engine 3 is used for vehicle propulsion.

When used with a transmission and clutch or fluid coupler the throttle valve 256 could be used controlling the flow of air through the combustion chamber and to the power cylinder; preferably used with throttle valves 262, 264, and 265 controlling pressure flow to power cylinders, and using bypass 266 controlled by throttle 267 to give air to the pilot 214. The flow to the small turbine or engine which drives the accessories would give vent to the combustion chamber to make the pilot burn. When throttles are opened, the air flow through air flow meter 105 would open fuel needle valve 224 to give fuel to main burner 204. When used with a transmission, hot head power pistons, inter stage cooler, compressor unloader control, air preheater, but without reversing gear, cutoff gear, and without changeover from compound to simple, but with two stage compression and expansion, this engine should give satisfactory preformance and fair economy. Used with cutoff gear, the economy should be better.

Engine 3 should give satisfactory preformance with much greater economy than the conventional Otto cycle internal combustion engine and a lot less emissions to cause air pollution. Engines 1 and 2 would be more economical and give less pollution to the air. The cost of the reverse gear, cut off gear and changeover from the compound to simple operation should cost less than a clutch and transmission or automatic transmission.

Engine 3 could be used with reverse gear only, with reverse gear and clutch on direct gear drive, or with reversing valve gear. Engine 3 could be used with direct gear drive.

Air receivers 187 and 188, FIG. 8, are used for storage of compressed air for starting and running the engine for a few moments until pilot and burners are lighted.

When the engine is stopped for a period and the switch turned off, solenoid operated block valve 256 on air line 255 is closed. Also, solenoid block valve 219 on main fuel line, and solenoid block valve 217 controlling fuel to pilot, are closed. These valves close when the switch is turned off.

When the switch is turned on to start the engine, this opens block valves 256 and 257 on air line from receivers 187 and 188. This pressures line 255 and preheater exchanger 54 up to throttle valve 262. Turning the switch on also heats up igniter 209; as the electric circuit through the heating element is in series with the solenoid valve 217, it opens, admitting fuel to the pilot, and igniting the pilot. Also, fuel pump 220, which is electrically of pneumatically driven, turned on. When the pilot is lighted, a sensor or thermocouple gets hot, retracts and turns off igniter 209, and opens main fuel supply valve 219 on main fuel supply line 218 from the fuel supply source. Also, the circuit closes to the pilot light solenoid 217, holding it open until the switch is turned off. This puts the fuel under pressure to fuel needle valve 224, which is held closed by springs 248 and 249. Air pressure and air temperature compensating devices 235 and 242 are in PO-1. When throttle valves 262, 264, or 265 are opened, the flow of air through air flow metering valve 105 via lever 233, rod 232, lever 231, 228A, and rod 228B, moves lever 227 from PO-1 toward PO-2, opening fuel valve 224, and admitting fuel to burner 210, which heats the incoming air expanding it to drive the engine. As soon as the compressor raises the air pressure line 255 to the predetermined pressure, pressure switch 258 opens, which closes solenoid block valve 257.

Line 266 is a bypass around throttle valve 262 and is controlled by adjustable flow valve 267. This bypass is intended to supply enough air to the burners and engine to idle the engine when engine 3 is used with a clutch and transmission or automatic transmission for vehicle propulsion.

FIG. 9 is an end view in elevation of a V-type engine designed to be mounted with the length of the crankshaft parallel with the length of the vehicle frame and designed to be used with a direct hypoid gear drive from the center or end of the crankshaft to the differental gear and axles to the wheels. The drive gear on the crankshaft is 268, the driven gear on the differental is 269 and the axles is 270.

FIG. 10 is an end view in elevation of a V-type engine designed to be mounted with the length of the crankshaft parallel with the length of the vehicle frame. It is designed for a helical gear driven from the center or end of the crankshaft for front or rear engine drive. The driver gear on the crankshaft is 271. The driven gear on the differental is 272 and the drive axles to the wheels are 273.

FIG. 11 is an end view in elevation of a V-type engine designed to be mounted with the length of the crankshaft parallel with the length of the vehicle frame. It is designed for a bevel or spiral bevel gear drive from the end of the crankshaft, driving either the front or rear wheels. The driver gear on the crankshaft is 274, the driver gear on the differental is 275, and the axles to the wheels are 276.

FIG. 12 is an end view in elevation of a V-type engine designed to be mounted with the crankshaft mounted parallel with the driving axles to the wheels at right angles to the length of the vehicle frame. It is designed for a spur gear or herringbone gear drive. The driver gear on the crankshaft is 277. The driven gear on the differental is 278. This drive can be used to drive either the front or rear wheels of the vehicle. This engine is shown in FIGS. 1, 2, and 7.

Each of these four drives has its advantages. As each sets on the driven axle the long drive shaft and the hump in the floor of the car is eliminated. The arrangements shown in FIGS. 11 and 12 allows the engine to be set lower, hence lower center of gravity for the vehicle.

FIG. 13 shows a cross section in elevation of a hot head piston. This is a power piston with a hot head separate and insulated from the main piston casting. This has the advantage of keeping the piston cooler and there is less heat loss from the pressure fluid medium used for power. As these engines all have charge air preheaters this makes for better thermal efficiency. The main piston casting is 279. The cylinder wall is 280. The hot head cap is 281 held in place by studs 282, pressured by springs 283, and sealed off by caps 284 tightened against gaskets 285 and held by bushings 286. The tension on springs 283 allows for the expansion of hot head 281 and studs 282. Hot head 281 is made of heat resistant material. The valves are 289. The cylinder head is 290. The valve springs are 291 and the valve stem equalizing pistons are 292.

The possible applications of the described pressure generators are very versatile. Engines using pressure generators can be built in many types and sizes, using the type of compressor suitable for the use the engine is designed for. They can be built for a charge pressure of pressures from 50 PSI up. Theoretically, the higher the charge pressure, the greater the efficiency. The pressure of 600 PSI; operating temperature of the pressure fluid medium of 1,600° F, and the preheat of the combustion air after compression to 800° F, are mere examples of a happy medium operating pressures and temperatures. The pressures and temperatures used can be suited to the use of the engine, the fuel used, and conditions operated under.

With the foregoing, and other objects in view, the invention resides in the novel arrangement and combination of parts and in details of construction hereinafter described and claimed, it being understood that changes in the precise embodiment of the invention herein disclosed may be made within the scope of what is claimed without departing from the spirit of the invention. Therefore, the invention is not limited by what is shown in the drawings and described in the specification but only as indicated by the appended claims.

What I claim and desire to secure by Letters Patent of the United States of America is:

1. I claim, a combustion products generator consisting of a constant pressure combustion chamber which is a pressure vessel having one or more fuel burners located inside said combustion chamber, a means to inject atomized fuel into said burners, a continuous means of ignition communicating with each burner, a means of forced circulation of a portion of the air within said combustion chamber through said burners for combustion air, a means of forced circulation of a portion of the air within said combustion chamber into the hot gases from said burners to dilute and cool said gases to workable temperatures, all internal parts to be made of heat resistant materials, a means to measure the volume of the air flow coming into said combustion products generator, a means to open or close the fuel valves to said fuel burners one at a time in ratio to volume of air so measured, an outlet opening in said combustion chamber, an inlet opening to said combustion chamber, said inlet opening connected to a source of air under pressure.

2. I claim, a combustion products generator consisting of a constant pressure combustion chamber which is a pressure vessel having one or more fuel burners located inside said combustion chamber, a means of injecting and atomizing fuel into said burners, a continuous means of ignition communicating with each burner, a means of forced circulation of a portion of the air within said combustion chamber for combustion air, a means of forced circulation of a portion of the air within said combustion chamber into the hot gases from said burners to dilute and cool said gases to workable temperatures, a means of metering the volume of the flow of air, a means to open or close the fuel valves to the burners one at a time in ratio to the volume of air so metered, a means to control the temperature within said combustion chamber at a predetermined level by controlling the amount of fuel burned, all internal parts to be made of heat resistant materials, an outlet opening in said combustion chamber, an inlet opening to said combustion chamber, said inlet opening connected to a source of air under pressure.

3. I claim, a combustion products generator consisting of a constant pressure combustion chamber which is a pressure vessel having one or more fuel burners located inside said combustion chamber, a means of injecting and atomizing fuel into said burners, a means of ignition retractable after ignition, an alternate means of ignition, a means to de-energize both ignitors, and retract first means in response to pilot ignition, a means of forced circulation of a portion of the air within said combustion chamber through said burners for combustion air, a means of forced circulation of a portion of the air within said combustion chamber into the hot gases from said burners to dilute and cool said gases to workable temperatures, all internal parts to be made of heat resistant materials, an outlet opening in said combution chamber a inlet opening to said combustion chamber, said inlet opening connected to a source of air under pressure.

4. I claim, a combustion products generator consisting of a constant pressure combustion chamber which is a pressure vessel having one or more fuel burners located inside said combustion chamber, a means to inject atomized fuel into said burners, a continuous means of ignition communicating with each burner, a means of forced circulation of a portion of the air within said combustion chamber through said burners for combustion air, a means of forced circulation of a portion of the air within said combustion chamber into the hot gases from said burners to dilute and cool said gases to workable temperatures, all internal parts to be made of heat resistant materials, a means to measure the volume of the air flow coming into said combustion products generator, a means to open or close the fuel valves to said fuel burners one at a time in ratio to volume of air so measured, a means to limit the fuel burned in ratio to the air pressure in said combustion chamber, an outlet opening in said combustion chamber an inlet opening to said combustion chamber, said inlet opening connected to a source of air under pressure.

5. I claim, a combustion products generator consisting of a constant pressure combustion chamber which is a pressure vessel, having one or more fuel burners located inside the outer shell of said combustion chamber, a means to inject atomized fuel into said burners, an ignition means to ignite said fuel, a means of forced circulation of the air within said combustion chamber, consisting of one or more fans driven by a means outside said combustion chamber, part of the air flow discharged from said fans to be directed through said burners for combustion air, part of the air flow discharged from said fans to be directed into the hot gases from said burners to mix with and dilute and cool said gases to workable temperatures, all internal parts to be made of heat resistant materials, all internal parts made of refactory materials to be made sectional to allow expansion, a controlled outlet opening in said combustion chamber, a controlled inlet opening in said combustion chamber, said inlet opening connected to a source of air under pressure.

6. I claim, a combustion products generator consisting of a constant pressure combustion chamber which is a pressure vessel, having one or more fuel burner barrels located inside the outer shell of said combustion chamber, a means to inject atomized fuel into said burner barrels, an ignition means to ignite said fuel, a means of forced circulating of the air within said combustion chamber, consisting of one or more fans driven by a means outside said combustion chamber, part of the air flow discharged from said fans to be directed through said burner barrel for combustion air, part of the air flow discharged from said fans to be directed into the hot gases from said burner barrels, to mix with and dilute and cool said hot gases to workable temperatures, the velocity of the combustion gases through the burner barrels to be in ratio to the length of the burner barrels so that the combustion takes place within the length of the burner barrel before dilution, all internal parts to be made of heat resistant material, a controlled outlet opening in said combustion chamber, a controlled inlet opening in said combustion chamber connected to a source of air under pressure.

7. I claim, a combustion products generator consisting of a constant pressure combustion chamber which is a pressure vessel, having one or more fuel burners located inside the outer shell of said combustion chamber, a means to inject atomized fuel into said burner, an ignition means to ignite said fuel, a means of forced circulation of the air within said combustion chamber, consisting of one or more fans driven by a means outside said combustion chamber, part of the air flow discharged from said fans to be directed through said burners for combustion air, part of the air flow discharged from said fans to be directed into the hot gases from said burners to mix with and cool and dilute said gases to workable temperatures, all internal parts to be made of heat resistant materials, a thermostatic means to control the temperature within said combustion chamber at a predetermined temperature by controlling the amount of fuel burned in said combustion chamber, a controlled outlet opening in said combustion chamber, a controlled inlet opening in said combustion chamber, said inlet opening connected to a source of air under pressure.

8. I claim, a combustion products generator consisting of a constant pressure combustion chamber which is a pressure vessel having one or more fuel burner barrels located inside said combustion chamber, a source of compressed air connected to the inlet of a flow metering means, the outlet of which is connected to the inlet of said combustion chamber through which the compressed air enters said combustion chamber, when and in a volume controlled by the demand of fluid medium by a prime mover, a means to inject and atomize fuel into said burner barrels, volume of fuel to burner to be controlled by said air flow metering means at a predetermined fuel to air ratio to the volume of combustion air flow, jetting action of the flow of combustion air into the burner barrel mixes the fuel and a portion of the air and makes force circulation of air within the combustion chamber, the jetting action of the diluting air into the burner jackets makes forced circulation of another portion of the air within the combustion chamber into the hot gases of combustion from the burner barrels, diluting the hot gases into useable temperatures, an outlet opening in said combustion chamber, for the flow of fluid medium to said prime mover.

9. I claim, a combustion products generator consisting of a constant pressure combustion chamber which is a pressure vessel having an insulating lining inside the outside shell of said combustion chamber, a protective heat resistant material lining inside said insulating lining of said combustion chamber, having one or more fuel burners located inside the outer shell of said combustion chamber, a means of injecting and atomizing fuel into said burner, an ignition means to ignite said fuel, a means of forced recirculation of the air and combustion products within said combustion chamber, consisting of one or more fans driven by a means outside said combustion chamber, part of the air flow discharged from said fans to be directed through said burners for combustion air, part of the air flow discharged from said fans to be directed into the hot gases from said burners to mix with and dilute and cool said gases to workable temperatures, all internal parts to be made of heat resistant materials, an outlet opening in said combustion chamber, an inlet opening connected to a source of air under pressure.

10. I claim in combination, a combustion products generator as described in claim number 5, a pressure seal system for a rotating shaft where said shaft passes through the exterior wall of a pressure vessel filled with a high temperature, high pressure fluid medium, comprising a flanged opening in said pressure vessel, a matching head to fit flanged opening having a aperture in said heat for said shaft to pass through, a rotatable fit bearing attached to the exterior of head to carry said shaft, a hard polished seal flange secured to and rotating with said shaft on the interior of, and adjacent to, and facing said head, a matching seal flange around said shaft, of softer antifriction material secured to the inside of said head and adjacent to said hard polished seal flange, a removably secured second flange means on said shaft on the exterior of, adjacent to, and facing said head, said second flange means comprising thrust bearing means secured to said shaft, and spring bias means to bias said thrust bearing means, producing an axial thrust on said shaft to move hard polished seal flange into rotating, slideable, pressure sealing contact with said matching seal flange, a stationary enclosure around said seal flange, removably attached pressure tight to the interior of said removeable head and having an outboard bearing of anti-friction material for the shaft on the interior and adjoining the pressure chamber, rotatably fitted to the shaft, a conduit from the exterior of the pressure vessel in communication with said tublar enclosure consisting of means to supply needed quantity of cool high pressure air to tubular enclosure to cool the seals and exclude hot pressure fluid medium from the seal area within said tublar enclosure, excess cooling air to flow into pressure vessel through suitable vent apertures.

* * * * *